US012270208B2

(12) United States Patent
Ikeda et al.

(10) Patent No.: US 12,270,208 B2
(45) Date of Patent: Apr. 8, 2025

(54) WALL MATERIAL AND WALL-MATERIAL BUILDING STRUCTURE

(71) Applicant: NICHIHA CORPORATION, Nagoya (JP)

(72) Inventors: Satoshi Ikeda, Nagoya (JP); Tomomi Hattori, Nagoya (JP); Tomoki Matsuoka, Nagoya (JP); Hiroki Norita, Nagoya (JP)

(73) Assignee: NICHIHA CORPORATION, Nagoya (JP)

( * ) Notice: Subject to any disclaimer, the term of this patent is extended or adjusted under 35 U.S.C. 154(b) by 19 days.

(21) Appl. No.: 17/840,180

(22) Filed: Jun. 14, 2022

(65) Prior Publication Data

US 2022/0307271 A1 Sep. 29, 2022

Related U.S. Application Data

(63) Continuation of application No. PCT/JP2020/046818, filed on Dec. 15, 2020.

(30) Foreign Application Priority Data

Dec. 16, 2019 (JP) ..... 2019-226375
Sep. 30, 2020 (JP) ..... 2020-166152

(51) Int. Cl.
*E04F 13/08* (2006.01)
*E04F 13/14* (2006.01)

(52) U.S. Cl.
CPC ..... *E04F 13/0898* (2013.01); *E04F 13/0846* (2013.01); *E04F 13/0891* (2013.01); *E04F 13/142* (2013.01)

(58) Field of Classification Search
CPC ..... E04F 13/0846; E04F 13/0891; E04F 13/0898; E04F 13/142
(Continued)

(56) References Cited

U.S. PATENT DOCUMENTS 6,460,311 B1 * 10/2002 Ito ..... E04F 13/0846 52/489.1
6,615,560 B2 * 9/2003 Ito ..... E04F 13/0846 248/220.21
(Continued)

FOREIGN PATENT DOCUMENTS

CN 110352282 A 10/2019
JP S47-038690 B1 9/1972
(Continued)

OTHER PUBLICATIONS

International Search Report for International Application No. PCT/JP2020/046818 dated Mar. 9, 2021 (3 sheets).
(Continued)

*Primary Examiner* — James J Buckle, Jr.
(74) *Attorney, Agent, or Firm* — Kratz, Quintos & Hanson, LLP

(57) ABSTRACT

[Object] To provide a wall material and a wall-material building structure that are suitable for achieving high water resistance in the wall-material building structure.
[Solution] A wall material X of the present invention has a surface-side joint portion 10 and a rear-side joint portion 20. A first resin film 31 is provided on at least one of an end surface 11*a* of the surface-side joint portion 10 and an end surface 21 of the rear-side joint portion 20. A second resin film 32 is provided on at least one of an extension surface 11*b* and an extension surface 22*b*. At a splice part where the surface-side joint portion 10 of one wall material X and the rear-side joint portion 20 of another wall material X are spliced together in a first direction D1, the end surfaces 11*a* and 21 and the first resin film 31 are disposed such that the end surfaces 11*a* and 21 face each other while a gap between the end surfaces 11*a* and 21 is filled with at least the first resin film 31, and the extension surfaces 11*b* and 22*b* and the second resin film 32 are disposed such that the extension
(Continued)

surfaces 11*b* and 22*b* face each other while a gap between the extension surfaces 11*b* and 22*b* is filled with at least the second resin film 32. A wall-material building structure Y of the present invention is formed by using such a wall material X.

13 Claims, 12 Drawing Sheets

(58) Field of Classification Search
USPC ..... 52/309.14
See application file for complete search history.

(56) References Cited

U.S. PATENT DOCUMENTS

| | | | | |
|---|---|---|---|---|
| 7,849,651 | B2 * | 12/2010 | Fujito | E04F 13/0889 52/235 |
| 2001/0045075 | A1 * | 11/2001 | Watanabe | E04F 13/0826 52/715 |
| 2002/0046536 | A1 * | 4/2002 | Hotta | E04F 13/0864 52/698 |
| 2012/0317909 | A1 * | 12/2012 | MacKenzie | E04F 13/0803 52/698 |
| 2020/0071934 | A1 | 3/2020 | Ochi | |

FOREIGN PATENT DOCUMENTS

| | | | |
|---|---|---|---|
| JP | S63-206544 | A | 8/1988 |
| JP | H05-028839 | U | 4/1993 |
| JP | H08-239944 | A | 9/1996 |
| JP | H11-030017 | A | 2/1999 |
| JP | 2000-154075 | A | 6/2000 |
| JP | 2001-180997 | A | 7/2001 |
| JP | 2004-58350 | A | 2/2004 |
| JP | 2005-127010 | A | 5/2005 |
| JP | 2005-153211 | A | 6/2005 |
| JP | 3130762 | U | 4/2007 |
| JP | 2007-198098 | A | 8/2007 |
| JP | 2010065426 | A | 3/2010 |
| JP | 2010-264454 | A | 11/2010 |
| JP | 2014-051804 | A | 3/2014 |

OTHER PUBLICATIONS

Written Opinion of the International Searching Authority for International Application No. PCT/JP2020/046818 dated Mar. 9, 2021 (5 sheets).

Extended European Search Report for corresponding European Patent Application No. 20902697.0 dated Nov. 27, 2023 (9 sheets).

Office Action for corresponding Japanese Patent Application No. 2020-166152: Notice of Reasons for Refusal mailed Nov. 19, 2024 (4 sheets, 4 sheets translation, 8 sheets total).

Office Action of corresponding Chinese Patent Application No. 202080086067.5: Notice of Reasons for Refusal dated Dec. 4, 2024 (8 sheets, 9 sheets translation, 17 sheets total).

Office Action of Canadian Patent Application No. 3,161,877 issued Jan. 17, 2025 (9 sheets).

* cited by examiner

WALL MATERIAL AND WALL-MATERIAL BUILDING STRUCTURE

TECHNICAL FIELD

The present invention relates to a wall material and a wall-material building structure.

A plurality of wall materials may be spliced together vertically and horizontally to thereby form an exterior wall of a building. A ceramic wall material formed in a plate shape with cement and fiber as main raw materials is known as a wall material for exterior walls. Ceramic wall materials are easily manufactured in a wide variety of patterns and colors, and are widely used as wall materials for exterior walls.

Wall materials such as ceramic wall materials that constitute exterior walls are exposed to ultraviolet, carbon dioxide, water due to rainfall, and the like under an exterior environment. In recent years, the influence of water on wall materials such as ceramic wall materials has been revealed. For example, water may cause discoloration and peeling of a coating on a surface of a wall material and may also cause generation of cracks and progress of neutralization in an internal texture that constitutes the wall material. In addition, depending on a temperature difference in environment, the action of repeated freezing and melting of water, that is, a freezing-melting action may accelerate local destruction of the wall material and the aforementioned peeling of the coating, and may deteriorate the wall material.

Therefore, measures for water resistance may be taken in wall materials for exterior walls, such as ceramic wall materials. Technologies relating to water resistance of wall materials for exterior walls in the related art are described in, for example, PTL 1 and PTL 2 presented below.

CITATION LIST

Patent Literature

PTL 1: Japanese Unexamined Patent Application Publication No. 8-239944

PTL 2: Japanese Unexamined Patent Application Publication No. 2000-154075

SUMMARY OF INVENTION

Technical Problem

In recent years, due to an increasing demand for longer life of a house, a wall material that is more excellent in water resistance, and a wall-material building structure that uses the wall material have been desired. The present invention has been conceived under such a circumstance, and an object of the present invention is to provide a wall material suitable for achieving high water resistance in a wall-material building structure, and a wall-material building structure that uses the wall material.

Solution to Problem

According to a first aspect of the present invention, a wall material is provided. This wall material has a front surface and a rear surface opposite to the front surface, and includes a surface-side joint portion positioned on one side in a first direction, a rear-side joint portion positioned on the other side in the first direction, at least one first resin film, and at least one second resin film.

The surface-side joint portion has a first end surface that faces the one side in the first direction, and a first extension surface that is positioned on the other side from the first end surface in the first direction and that faces the side of the rear surface. The rear-side joint portion has a second end surface that faces the other side in the first direction, and a second extension surface that is positioned on the other end from the second end surface in the first direction and that faces the side of the front surface. The first resin film is positioned on at least one of the first end surface and the second end surface. The second resin film is positioned on at least one of the first extension surface and the second extension surface.

At a splice part where the surface-side joint portion of the one wall material and the rear-side joint portion of the wall material that differs from the one wall material are spliced together in the first direction, the first end surface, the second end surface, and the first resin film are disposed such that the first end surface and the second end surface face each other while a gap between the first end surface and the second end surface is filled with at least the first resin film. In addition, at the splice part, the first extension surface, the second extension surface, and the second resin film are disposed such that the first extension surface and the second extension surface face each other while a gap between the first extension surface and the second extension surface is filled with at least the second resin film.

In the present wall material, as described above, the first resin film is positioned on at least one of the first end surface and the second end surface, and the second resin film is positioned on at least one of the first extension surface and the second extension surface. In a state in which two sheets of such wall materials are spliced together by being mutually aligned in the aforementioned first direction via the surface-side joint portion and the rear-side joint portion thereof, at the splice part, as described above, the first end surface and the second end surface face each other in an arrangement in which the gap between the first end surface and the second end surface is filled with at least the first resin film, and the first extension surface and the second extension surface face each other in an arrangement in which the gap between the first extension surface and the second extension surface is filled with at least the second resin film. Such a configuration is suitable for preventing/suppressing infiltration of water such as rainwater into the rear surface side (interior side) at the splice part of the wall materials (that is, suitable for ensuring water stopping characteristics) and thus is suitable for achieving high water resistance in the wall-material building structure.

As described above, the wall material according to the first aspect of the present invention is suitable for achieving high water resistance in a wall-material building structure.

Preferably, at least one of the first resin film and the second resin film contains at least one resin selected from the group consisting of a thermoplastic resin, a thermosetting resin, and an ultraviolet-curable resin. Such a configuration is suitable for ensuring a water stopping function in a resin film.

In one preferred form, at least one of the first resin film and the second resin film is a resin sheet. The resin sheet is easily manufactured with high-precision in terms of the thickness dimension thereof and thus is easily prepared as a sheet formed to have a uniform thickness. Accordingly, such a configuration is suitable for providing the present wall material with a resin film with precision in thickness.

In one preferred form, the surface-side joint portion has a chamfered-shape portion between the first end surface and the first extension surface, and the resin film at the surface-side joint portion is formed in a region stretching on the first end surface, on the chamfered-shape portion, and on the first extension surface. Such a configuration is suitable for forming a resin film that is continuous with a sufficient thickness on a resin-film formation planned region in the surface-side joint portion.

Preferably, the resin film includes a first layer as an underlayer, and a second layer on the first layer. More preferably, the first layer includes air bubbles, and the second layer includes no air bubbles, or air bubbles in the inside of the second layer are less than the air bubbles in the inside of the first layer.

Such a configuration is suitable, in formation of a resin film, for forming the first layer by applying and drying a relatively low-viscosity resin composition and then forming, on the first layer, the second layer by applying and drying a relatively high-viscosity resin composition. Applying and drying the relatively low-viscosity resin composition cause the composition to easily penetrate partially into a wall-material surface, thus cause air bubbles to enter the composition easily due to a fine irregular shape of the wall-material surface, but easily form the first layer exerting favorable adhesion with respect to the wall-material surface. Applying and drying a relatively high-viscosity resin composition on such a first layer easily form the second layer exerting favorable adhesion with respect to the first layer while preventing or suppressing air bubbles from mixing into the composition. The resin film tends to have higher water resistance as the amount of air bubbles mixed in the resin film is smaller. Therefore, the above-described configuration in which the resin film has a multilayer structure is suitable for forming a resin film excellent in water resistance in a predetermined region with high adhesion.

In one preferred form, the first layer and the second layer are each a thermosetting resin coating. The thermosetting resin coating is excellent in water resistance and weather resistance and tends to have excellent adhesion with respect to a wall material. Thus, the configuration in which the resin film has a multilayer structure with thermosetting resin coatings is suitable for forming a resin film excellent in weather resistance, in addition to water resistance, with excellent adhesion.

In one preferred form, the first layer is a thermoplastic resin coating, and the second layer is a thermoplastic resin sheet. Such a configuration can be achieved by, for example, forming the first layer, which is a thermoplastic resin coating, through application and drying of a thermoplastic resin composition and then forming, on the first layer, the second layer with a thermoplastic resin sheet. Applying and drying a thermoplastic resin composition cause the composition to easily penetrate partially into a wall-material surface and thus easily form the first layer exerting favorable adhesion with respect to the wall-material surface. Applying and drying a relatively low-viscosity resin composition cause the composition to easily penetrate partially into a wall-material surface, thus easily cause air bubbles to enter the composition due to a fine irregular shape of the wall-material surface, but easily form the first layer exerting favorable adhesion with respect to the wall-material surface, which is preferable. Bonding a thermoplastic resin sheet to such a first layer easily forms the second layer exerting favorable adhesion with respect to the first layer. The thermoplastic resin sheet is easily manufactured with high-precision in the thickness dimension thereof and easily prepared as a sheet formed to have a uniform thickness. Accordingly, the aforementioned configuration is suitable for forming a resin film excellent in water resistance and adhesion with precision in thickness.

In one preferred form, the present wall material further includes a first caulking portion. The first caulking portion is positioned on at least one of the second resin film on the first extension surface, and the second resin film on the second extension surface.

In one preferred form, the present wall material further includes a second caulking portion. The second caulking portion is positioned, on the first extension surface, on the other side in the first direction from the second resin film on the first extension surface, and is thicker than the second resin film.

In one preferred form, the present wall material further includes a third caulking portion. The third caulking portion is positioned, on the second extension surface, on the other side in the first direction from the second resin film on the second extension surface, and is thicker than the second resin film.

Each of the aforementioned configurations in which a caulking portion is utilized is suitable, when two sheets of the present wall materials are spliced together by being mutually aligned in the first direction via the surface-side joint portion and the rear-side joint portion thereof, for filling a gap at the splice part between the first extension surface and the second extension surface with the second resin film and the caulking portion (that is, suitable for obtaining a water stopping function by cooperation of the second resin film and the caulking portion). Therefore, the configuration is useful for achieving high water resistance in the wall-material building structure.

Preferably, the surface-side joint portion has a groove portion that is positioned on the other side from the first extension surface in the first direction, and a first secured portion that is positioned closer than the groove portion to the rear surface and that is adjacent to the first extension surface via the groove portion. In addition, the rear-side joint portion has a second secured portion that is positioned closer than the second end surface to the rear surface and that extends further toward the other side in the first direction than the second end surface. In addition, the present wall material is configured such that, at the splice part where the surface-side joint portion of one wall material and the rear-side joint portion of another wall material are spliced together in the first direction, the first secured portion and the second secured portion are separated from and face each other in the first direction.

In a state in which two sheets of the present wall materials each having such a configuration are spliced together by being mutually aligned as described above, an internal space that includes at least the groove portion between the first extension surface and the first secured portion at the surface-side joint portion is formed at an intermediate portion in the thickness direction of the wall materials at the splice part. In addition, at the splice part, the first secured portion and the second secured portion are separated from and face each other in the first direction, as described above. In other words, at the splice part, a gap that is continuous with the aforementioned internal space is formed between the first secured portion and the second secured portion. Such a configuration is suitable for suppressing occurrence of dew condensation in the inside of the internal space by ensuring ventilation of the internal space. The configuration is also suitable for discharging, when dew condensation occurs in the inside of the internal space, the dew condensation water from the inside of the wall materials via the gap. Accordingly, the configuration is useful for achieving high water resistance in the wall-material building structure.

In the present wall material, preferably, no resin film is formed at the first secured portion and the second secured portion.

The inner surface of the groove portion, which is at least a portion of the aforementioned internal space that is formed in the state in which two sheets of the present wall materials each having such a configuration are spliced together as described above by being mutually aligned, is not covered with the resin film. According to such a configuration, when dew condensation occurs in the inside of the internal space, an effect of causing at least a portion of the dew condensation water to be absorbed by wall-material surfaces such as the first extension surface of the surface-side joint portion is easily obtained. The absorption is suitable for suppressing generation of, for example, local destruction in the wall materials due to the freezing-melting action of water such as dew condensation water in the inside of the internal space. Accordingly, the absorption is useful for achieving high water resistance in the wall-material building structure.

According to a second aspect of the present invention, a wall-material building structure is provided. This wall-material building structure includes a support material, a first wall material, a second wall material, and a fastener for fastening the first and second wall materials to the support material.

The first wall material and the second wall material are fastened to the support material to be adjacent to each other in a first direction. Each of the first wall material and the second wall material is the above-described wall material according to the first aspect of the present invention. The present wall material is configured such that the surface-side joint portion of the first wall material and the rear-side joint portion of the second wall material are spliced together in the first direction, and, at the splice part, the first end surface and the second end surface face each other in an arrangement in which a gap between the first end surface of the surface-side joint portion and the second end surface of the rear-side joint portion is filled with at least the first resin film while the first extension surface and the second extension surface face each other in an arrangement in which a gap between the first extension surface of the surface-side joint portion and the second extension surface of the rear-side joint portion is filled with at least the second resin film. The fastener has a fixing portion that is fixed to the support material, and a securing structure portion that secures the first wall material and the second wall material.

In the present wall-material building structure, as described above, at the aforementioned splice part of the first wall material and the second wall material, the first end surface and the second end surface face each other in the arrangement in which the gap between the first end surface and the second end surface is filled with the first resin film, and the first extension surface and the second extension surface face each other in the arrangement in which the gap between the first extension surface and the second extension surface is filled with the second resin film. Such a configuration is suitable for preventing/suppressing infiltration of water such as rainwater into the rear surface side (interior side) at the splice part of the first and second wall materials and thus is suitable for achieving high water resistance in the wall-material building structure.

As described above, the wall-material building structure according to the second aspect of the present invention is suitable for achieving high water resistance.

DESCRIPTION OF EMBODIMENTS

Figure 1:
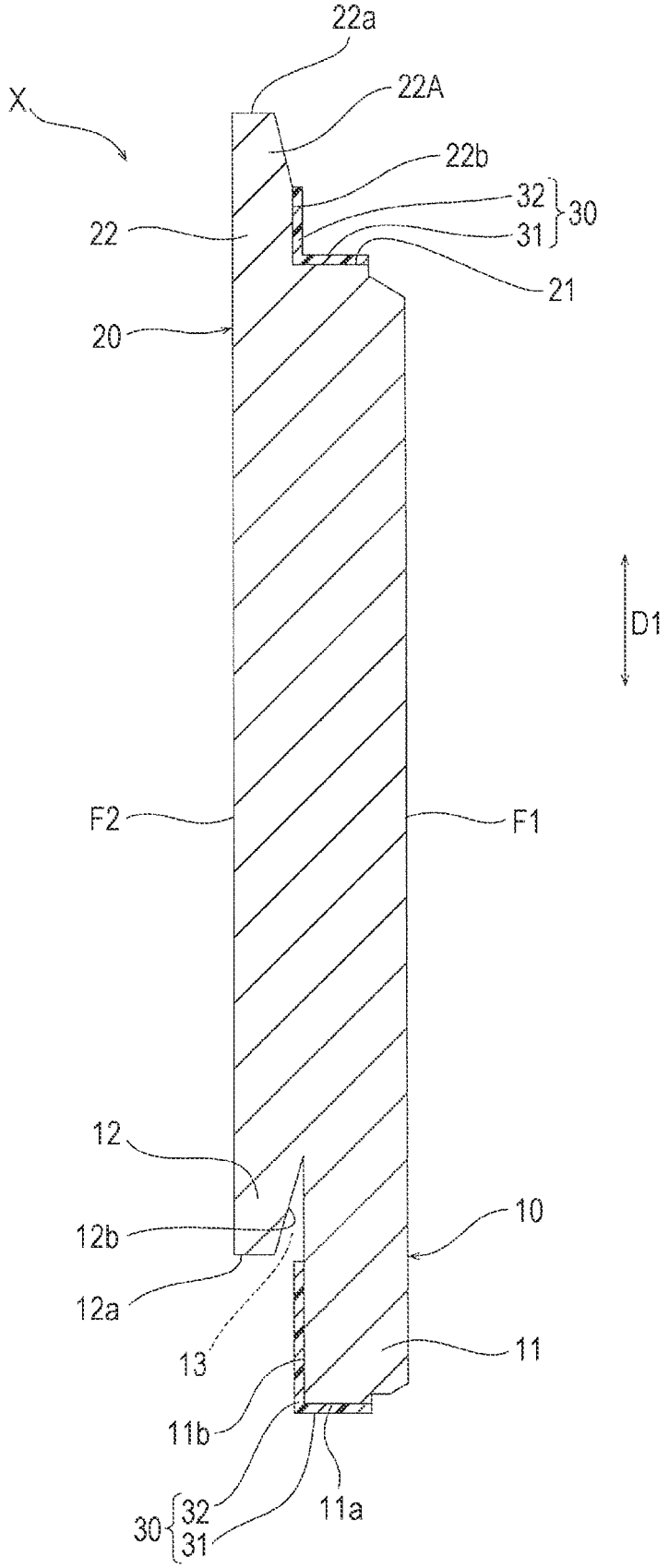
FIG. 1 is a sectional view of a wall material according to a first embodiment of the present invention.

FIG. 1 is a sectional view of a wall material X according to a first embodiment of the present invention. The wall material X is a construction plate material for constituting an exterior wall of a building. To build an exterior wall, a plurality sheets of the wall materials X are fastened while being spliced together in the up-down direction (vertical direction) and the left-right direction (lateral direction), via a fastener to a predetermined support material included in a building frame.

The wall material X has a front surface F1 and a rear surface F2 opposite to the front surface F1. A design surface is formed on the front surface F1. The design surface has, for example, a rectangular shape (not illustrated) in front view. The outline shape of the design surface is defined by a pair of end edges extending in a first direction D1 indicated in FIG. 1 and a pair of end edges extending in a second direction intersecting the first direction D1. The dimension of such a design surface in the first direction D1 is, for example, 400 to 1000 mm, and the dimension thereof in the second direction is, for example, 900 to 3100 mm. The first direction D1 and the second direction are preferably orthogonal to each other. The thickness of the wall material X, that is, a dimension between the front surface F1 and the rear surface F2 is, for example, 12 to 25 mm.

The wall material X has a surface-side joint portion 10 positioned on one side (lower side in FIG. 1) in the first direction D1, and a rear-side joint portion 20 positioned on the other side (upper side in FIG. 1) in the first direction D1. The surface-side joint portion 10 extends in the above-described second direction on the one side in the first direction D1. The rear-side joint portion 20 extends in the second direction on the other side in the first direction D1.

The surface-side joint portion 10 is an end portion having a shape suitable for splicing the wall materials X together. In the present embodiment, the surface-side joint portion 10 is an end portion having an upper shiplap structure. Specifically, the surface-side joint portion 10 has a surface-side extension portion 11, a secured portion 12 (first secured portion), and a groove portion 13. The surface-side extension portion 11 and the secured portion 12 are adjacent to each other via the groove portion 13 in the thickness direction of the wall material X. The surface-side extension portion 11 is positioned closer than the secured portion 12 and the groove portion 13 to the front surface F1. The secured portion 12 is positioned closer than the surface-side extension portion 11 and the groove portion 13 to the rear surface F2.

The surface-side extension portion 11 extends further toward the one side in the first direction D1 than the secured portion 12. The surface-side extension portion 11 has an end surface 11*a* (first end surface) and an extension surface 11*b* (first extension surface). The end surface 11*a* is positioned at an extension end of the surface-side extension portion 11 in the first direction D1 and faces the one side in the first direction D1. The extension surface 11*b* is positioned between the end surface 11*a* and the groove portion 13 in the first direction D1 (that is, positioned on the other side from the end surface 11*a* in the first direction D1) and faces the rear surface F2.

The secured portion 12 is a part that is to be secured by the fastener for fastening a wall material to the support material. The secured portion 12 has an end surface 12*a* and an inclined surface 12*b*. The end surface 12*a* faces the one side in the first direction D1 and is located at a position withdrawn from the end surface 11*a* of the surface-side extension portion 11 toward the other side in the first direction D1. The inclined surface 12*b* is inclined with respect to the first direction D1 to be closer to the front surface μl as a distance from the end surface 12*a* increases. Such an inclined surface 12*b* forms a portion of the inner surface of the groove portion 13.

The rear-side joint portion 20 is an end portion having a shape suitable for splicing the wall materials X together. In the present embodiment, the rear-side joint portion 20 is an end portion having a lower shiplap structure. Specifically, the rear-side joint portion 20 has an end surface 21 (second end surface) and a rear-side extension portion 22.

The end surface 21 is positioned closer to the front surface F1 at the rear-side extension portion 22 and faces the other side in the first direction D1.

The rear-side extension portion 22 is positioned closer than the end surface 21 to the rear surface F2 and extends further toward the other side in the first direction D1 than the end surface 21. The rear-side extension portion 22 includes a secured portion 22A having an end surface 22*a*, and has an extension surface 22*b* (second extension surface). The secured portion 22A is a part to be secured by the fastener for fastening a wall material to the support material, and is positioned at a tip portion of the rear-side extension portion 22 in the first direction D1. The end surface 22*a* of the secured portion 22A is positioned at the other end of the rear-side extension portion 22 in the first direction D1 and faces the other side in the first direction D1. The extension surface 22*b* is positioned between the secured portion 22A and the end surface 21 in the first direction D1 (that is, positioned on the other side from the end surface 21 in the first direction D1) and faces the front surface F1.

The wall material X having the shape described above is a ceramic wall material (ceramic siding board). Preferably, the wall material X is a ceramic wall material covered with a coating. Such a configuration is suitable for obtaining favorable waterproof characteristics in the wall material X that is exposed under an exterior environment, and thus is useful for achieving high water resistance in a wall-material building structure constituted by including the wall material X.

The ceramic wall material is, for example, an inorganic plate formed into a plate shape with cement and fiber as main raw materials. Examples of the ceramic wall material include, for example, a wood fiber reinforced cement board, a fiber reinforced cement board, and a fiber reinforced cement/calcium silicate board.

The aforementioned coating is formed by, for example, applying and drying a paint that contains a resin component. Examples of the resin component of the paint include, for example, an acrylic resin, an acrylic silicone resin, a silicone resin, a fluororesin, a polyurethane resin, and an epoxy resin. The resin component is selected according to a function of the coating. The paint for coating-film formation or a coating formed by the paint may contain a pigment. Examples of the pigment include, for example, calcium carbonate, clay, titanium oxide, carbon black, red iron oxide, chrome yellow, iron oxide, ultramarine, phthalocyanine blue, cobalt, and chromium oxide. For application of the paint, for example, flow coating and a roll coater are usable. The paint may be formed to be a film by spray application. The coating is dried at a normal temperature or is dried in a dryer at 50° C. to 120° C. depending on the type of the coating or the contained resin component. The thickness of the coating is, for example, 50 to 100 μm.

The coating may have a layered structure including a plurality of layers. For example, the coating formed on the front surface F1 has a layered structure that includes a sealer layer, an undercoat coating, an intermediate coat coating, and a clear coating in this order from the base material side.

The sealer layer is formed by, for example, applying and drying a paint that contains, as a main component, at least one of an acrylic resin and an acrylic urethane resin. The sealer layer may contain a pigment. Each of the undercoat coating and the intermediate coat coating is formed by, for example, applying and drying a paint that contains, as a main component, at least one component selected from the group consisting of an acrylic resin, an acrylic urethane resin, an acrylic silicone resin, a fluororesin, an alkyd resin, a urethane resin, a silicone resin, and an epoxy resin. The intermediate coat coating may contain a pigment. The clear coating is formed by, for example, applying and drying a paint that contains, as a main component, at least one component selected from the group consisting of an acrylic resin, an acrylic urethane resin, an acrylic silicone resin, a fluororesin, a urethane resin, and a silicone resin.

The wall material X includes a first resin film 31 and a second resin film 32. In the present invention, the first resin film 31 is positioned on at least one of the end surface 11*a* (first end surface) of the surface-side joint portion 10 and the end surface 21 (second end surface) of the rear-side joint portion 20. The second resin film 32 is positioned on at least one of the extension surface 11*b* (first extension surface) of the surface-side joint portion 10 and the extension surface 22*b* (second extension surface) of the rear-side joint portion 20. The first resin film 31 and the second resin film 32 are formed on or under the above-described coating. A part at which the first resin film 31 and the second resin film 32 are positioned has a thickness thicker than the thickness of the other part at which only the coating is formed, to be excellent in water resistance and suitable for preventing/suppressing infiltration of water such as rainwater from a splice part of the wall materials when built.

In the present embodiment, the wall material X has the first resin film 31 positioned on the end surface 11*a*, and the second resin film 32 positioned on the extension surface 11*b*, the first resin film 31 and the second resin film 32 being continuous to form a resin film 30. The wall material X in the present embodiment has the first resin film 31 positioned on the end surface 21, and the second resin film 32 positioned on the extension surface 22*b*, the first resin film 31 and the second resin film 32 being continuous to form the resin film 30.

In other words, in the wall material X of the present embodiment, the resin film 30 (the first resin film 31 and the second resin film 32) is provided in a region (first region) in the surface-side joint portion 10 stretching on the end surface 11*a* and the extension surface 11*b* of the surface-side extension portion 11, and the resin film 30 (the first resin film 31 and the second resin film 32) is also provided in a region (second region) in the rear-side joint portion 20 stretching on the end surface 21 and on the extension surface 22*b* of the rear-side extension portion 22. The resin film 30 is an element that is, in a state in which two sheets of the wall materials X are spliced together in the first direction D1 by being mutually aligned via the surface-side joint portion 10 and the rear-side joint portion 20 thereof, interposed in a predetermined region between the surface-side joint portion 10 and the rear-side joint portion 20.

Such a resin film 30, that is, the first resin film 31 and the second resin film 32 are formed by, for example, applying and drying a composition that contains a resin component as a main agent. Examples of the resin component include a thermoplastic resin, a thermosetting resin, and an ultraviolet-curable resin. Examples of the thermoplastic resin include, for example, a polyethylene resin, a polypropylene resin, a methacrylic resin, and a thermoplastic polyurethane resin. Examples of the thermosetting resin include an epoxy resin, a melamine resin, and a thermosetting polyurethane resin. An example of the ultraviolet-curable resin is a resin composition that contains a base polymer, a polymerizable compound such as an epoxy monomer, and a photopolymerization initiator. The thickness of the resin film 30 is, for example, 50 to 800 mm.

Alternatively, at least one of the first resin film 31 and the second resin film 32 may be a resin sheet. As the resin sheet, a thermoplastic resin sheet is preferably used. Examples of the main component of the thermoplastic resin sheet include, for example, polyethylene, polypropylene, polyvinyl chloride, polystyrene, polyethylene terephthalate, polyvinyl alcohol, polyvinylidene chloride, a methacrylic resin, and an acrylonitrile styrene resin. The thickness of the resin sheet is, for example, 50 to 400 μm. The resin sheet is easily manufactured with high-precision in terms of the thickness dimension thereof and thus is easily prepared as a sheet formed to have a uniform thickness. Accordingly, the aforementioned configuration is suitable for providing the wall material X with the resin film 30 with precision in thickness.

The wall material X is designed such that two sheets of the wall materials X can be spliced together in the first direction D1 by being mutually aligned via the surface-side joint portion 10 and the rear-side joint portion 20. Specifically, the wall material X is designed or configured such that, at the splice part where the surface-side joint portion 10 of one wall material X and the rear-side joint portion 20 of another wall material X are spliced together in the first direction D1, the following facing relationships are achieved.

In an arrangement in which a gap between the end surface 11*a* at the surface-side joint portion 10 of the one wall material X and the end surface 21 at the rear-side joint portion 20 of the other wall material X is filled with at least the first resin film 31, the end surface 11*a* and the end surface 21 face each other at the aforementioned splice part. In an arrangement in which a gap between the extension surface 11*b* at the surface-side joint portion 10 of the one wall material X and the extension surface 22*b* at the rear-side joint portion 20 of the other wall material X is filled with at least the second resin film 32, the extension surface 11*b* and the extension surface 22*b* face each other at the aforementioned splice part. At the aforementioned splice part, the secured portion 12 at the surface-side joint portion 10 of the one wall material X and the secured portion 22A at the rear-side joint portion 20 of the other wall material X are separated from and face each other in the first direction D1. These facing relationships regarding a wall-material building structure according to another embodiment are as described below with reference to FIG. 2 and FIG. 3.

Figure 2:
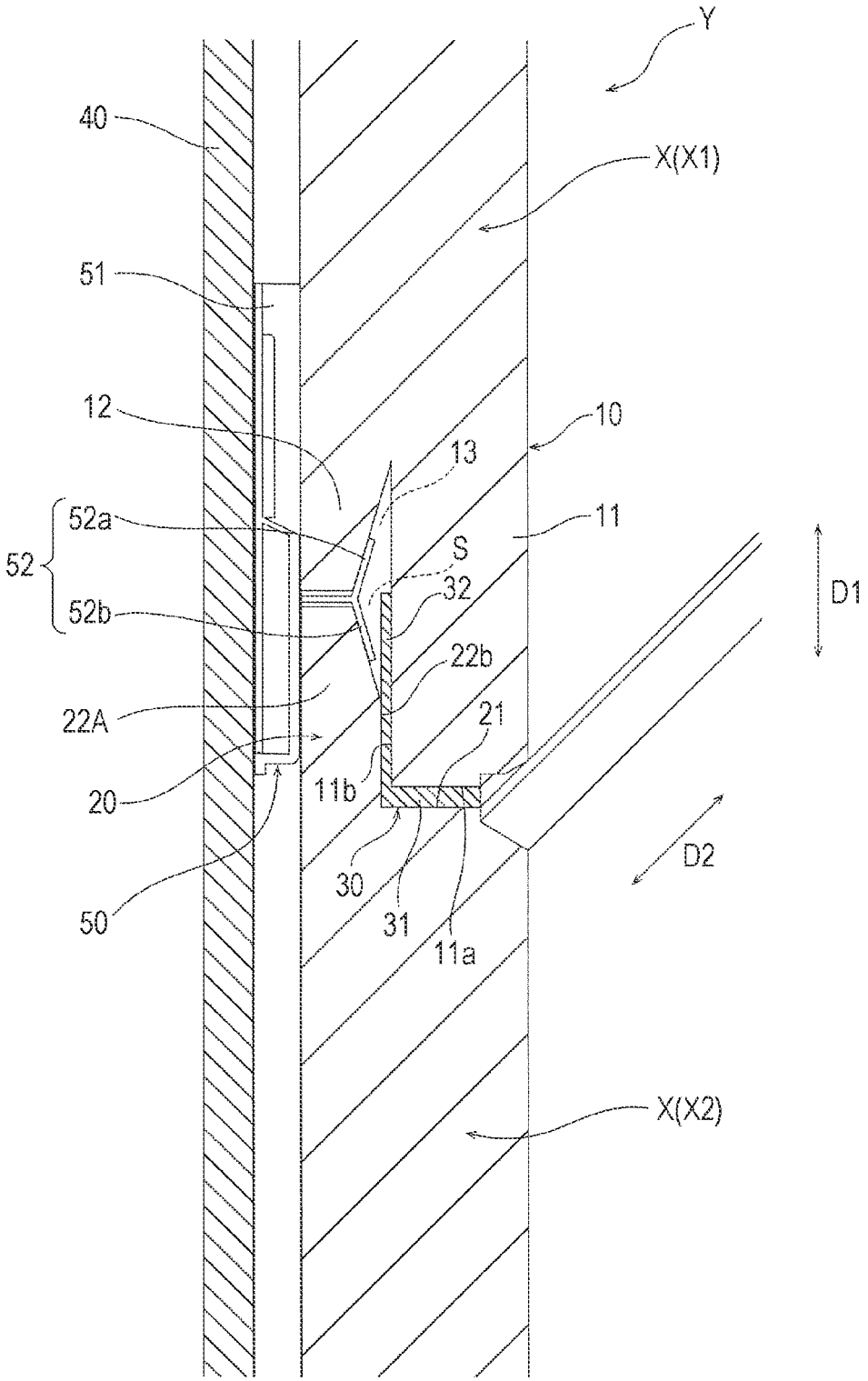
FIG. 2 is one vertical section of a wall-material building structure according to a second embodiment of the present invention.
Figure 3:
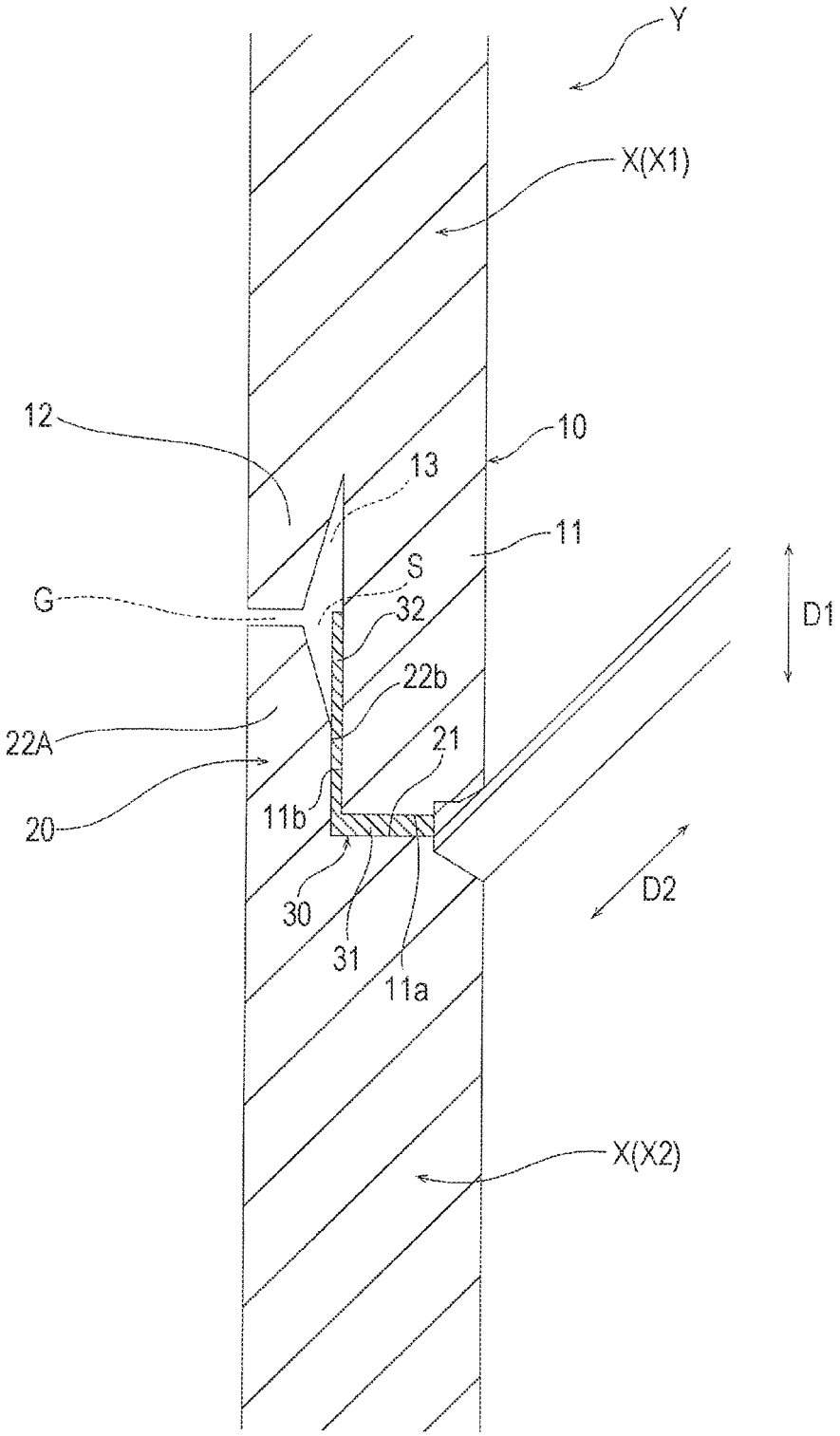
FIG. 3 is another vertical section of the wall-material building structure according to the second embodiment of the present invention.

FIG. 2 and FIG. 3 each illustrate a wall-material building structure Y according to a second embodiment of the present invention. FIG. 2 illustrates a partial vertical section of the wall-material building structure Y. FIG. 3 illustrates a partial vertical section of the wall-material building structure Y at a different part. FIG. 2 and FIG. 3 illustrate such that the above-described first direction D1 is oriented in the vertical direction.

The wall-material building structure Y includes a support material 40, a fastener 50, and a plurality of the wall materials X described above.

The support material 40 is a support material included in a building frame and is, for example, a furring strip. In the present embodiment, a vertical furring strip extending in the vertical direction is presented as an example of the support material 40. In the wall-material building structure Y, a plurality of the support materials 40 are disposed at predetermined intervals in the lateral direction.

Figure 4:
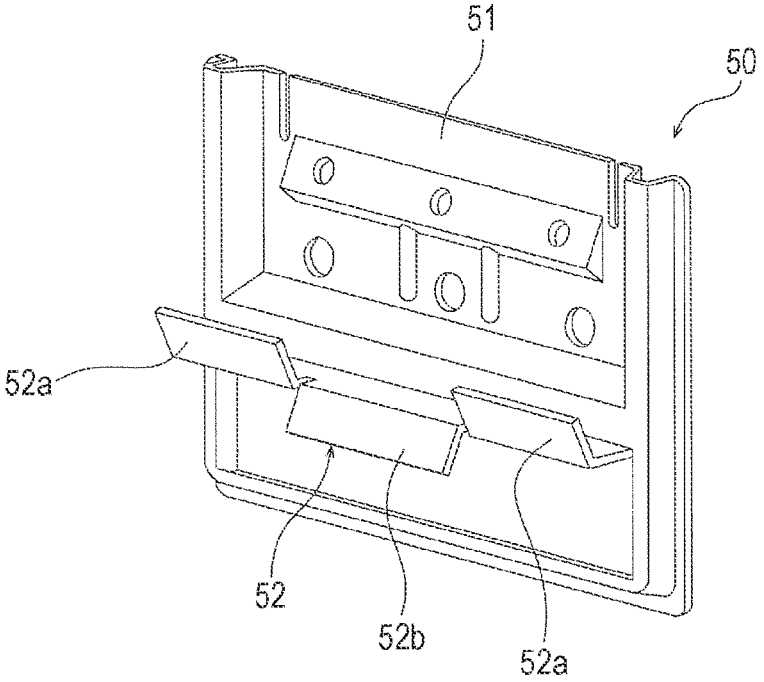
FIG. 4 illustrates one example of a fastener used for the wall-material building structure.

The fastener 50 is a component for fastening the wall material X to the support material 40. As illustrated in FIG. 2, the fastener 50 has a fixing portion 51 fixed to the support material 40, and a securing structure portion 52. The securing structure portion 52 includes securing portions 52*a* and 52*b*. The securing portion 52*a* has a bent shape that extends from the fixing portion 51 to be capable of securing the secured portion 12 of the surface-side joint portion 10 of the wall material X. In the wall-material building structure Y, the securing portion 52*a* is partially inserted into the groove portion 13 of the surface-side joint portion 10 of a wall material X1. The securing portion 52*b* has a bent shape that extends from the fixing portion 51 to be capable of securing the secured portion 22A of the rear-side joint portion 20 of the wall material X. In the wall-material building structure Y, the securing portion 52*b* is partially inserted into a gap between the secured portion 22A of the rear-side joint portion 20 of a wall material X2 and the surface-side extension portion 11 of the surface-side joint portion 10 of the wall material X1. An example of the constituent material of such a fastener 50 is, for example, stainless steel. A specific example of the fastener 50 is illustrated in FIG. 4.

As illustrated in FIG. 2 and FIG. 3, in a state of being spliced together by being mutually aligned in the first direction D1 (vertical direction in the present embodiment) via the surface-side joint portion 10 of the wall material X1 and the rear-side joint portion 20 of the wall material X2, the wall materials X1 and X2 adjacent to each other in the vertical direction in the plurality of wall materials X included in the wall-material building structure Y are fastened to the support material 40 via the fastener 50.

In a state in which a gap between the end surface 11*a* of the surface-side joint portion 10 of the wall material X1 and the end surface 21 of the rear-side joint portion 20 of the wall material X2 is filled with the first resin film 31, the end surface 11*a* and the end surface 21 face each other at the splice part of the wall materials X1 and X2. In a state in which a gap between the extension surface 11*b* of the surface-side joint portion 10 of the wall material X1 and the extension surface 22*b* of the rear-side joint portion 20 of the wall material X2 is filled with the second resin film 32, the extension surface 11*b* and the extension surface 22*b* face each other at the splice part. In the present embodiment, the resin film 30 between the surface-side joint portion 10 and the rear-side joint portion 20 in the wall-material building structure Y include the resin film 30 (the first resin film 31 and the second resin film 32) on the surface-side joint portion 10 and the resin film 30 (the first resin film 31 and the second resin film 32) on the rear-side joint portion 20, which are described above with reference to FIG. 1 regarding the wall material X, the resin films 30 being joined together to be integral with each other.

At the aforementioned splice part in the wall-material building structure Y, the secured portion 12 of the surface-side joint portion 10 of the wall material X1 and the secured portion 22A of the rear-side joint portion 20 of the wall material X2 are separated from and face each other in the first direction D1.

At the splice part of the wall materials X1 and X2 in the wall-material building structure Y having the above-described configuration, as described above, in the state in which the gap between the end surface 11*a* and the end surface 21 is filled with the first resin film 31, the end surface 11*a* and the end surface 21 face each other, and, in the state in which the gap between the extension surface 11*b* and the extension surface 22*b* is filled with the second resin film 32, the extension surface 11*b* and the extension surface 22*b* face each other. Such a configuration is suitable for preventing/suppressing infiltration of water such as rainwater into the rear surface side (interior side) at the splice part of the wall materials X1 and X2, and thus is suitable for achieving high water resistance in the wall-material building structure Y.

In the wall-material building structure Y, the internal space S including the groove portion 13 between the surface-side extension portion 11 and the secured portion 12 at the surface-side joint portion 10 of the wall material X1 is formed at an intermediate portion in the thickness direction of the wall materials at the splice part of the wall materials X1 and X2. In addition, at the splice part, as described above, the secured portion 12 of the surface-side joint portion 10 and the secured portion 22A of the rear-side joint portion 20 are separated from and face each other in the first direction D1. In other words, at the splice part, a gap G continuous with the internal space S is formed between the secured portions 12 and 22A as illustrated in, for example, FIG. 3. Such a configuration is suitable for suppressing generation of dew condensation in the inside of the internal space S by ensuring ventilation of the internal space S. The configuration is also suitable for discharging, when dew condensation occurs in the inside of the internal space S, the dew condensation water from the inside of the wall material via the gap G. Accordingly, the configuration is useful for achieving high water resistance in the wall-material building structure Y.

In addition, in the wall-material building structure Y, the inner surface of the groove portion 13, which is a portion of the internal space S, is not covered with the resin film 30. According to such a configuration, when dew condensation occurs in the inside of the internal space S, an effect of causing the dew condensation water to be absorbed, even partially, by wall-material surfaces such as the extension surface 11*b* of the surface-side extension portion 11 is easily obtained. The absorption is suitable for suppressing, for example, occurrence of local destruction in the wall material X due to the freezing-melting action of water such as dew condensation water in the inside of the internal space S. Accordingly, the absorption is useful for achieving high water resistance in the wall-material building structure Y.

Figure 5:
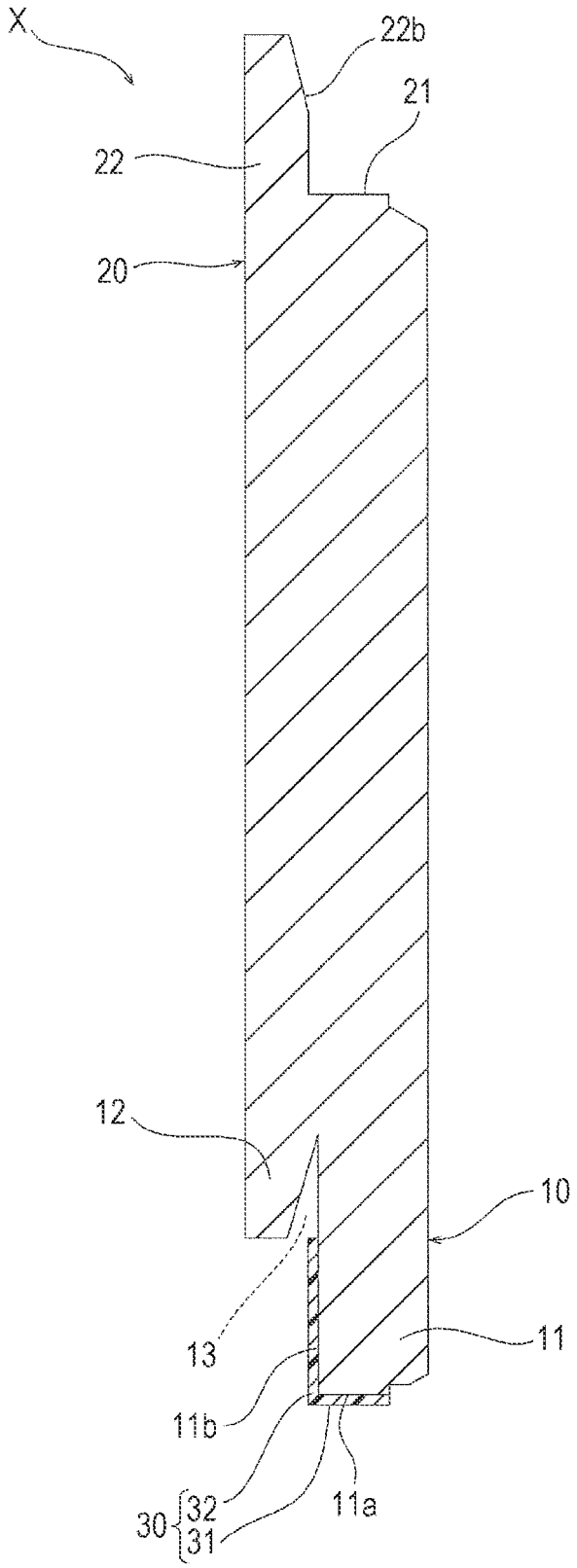
FIG. 5 illustrates one modification of the wall material illustrated in FIG. 1.

The wall material X in such a wall-material building structure Y may employ, instead of the above-described configuration in which the resin film 30 is formed in both the first region and the second region, a configuration in which, as illustrated in FIG. 5, the resin film 30 is formed in the first region (the region stretching on the end surface 11*a* and on the extension surface 11*b* of the surface-side extension portion 11 of the surface-side joint portion 10) and is not formed in the second region. In this case, the thickness of the resin film 30 on the first region is, for example, 50 to 400 mm.

Figure 6:
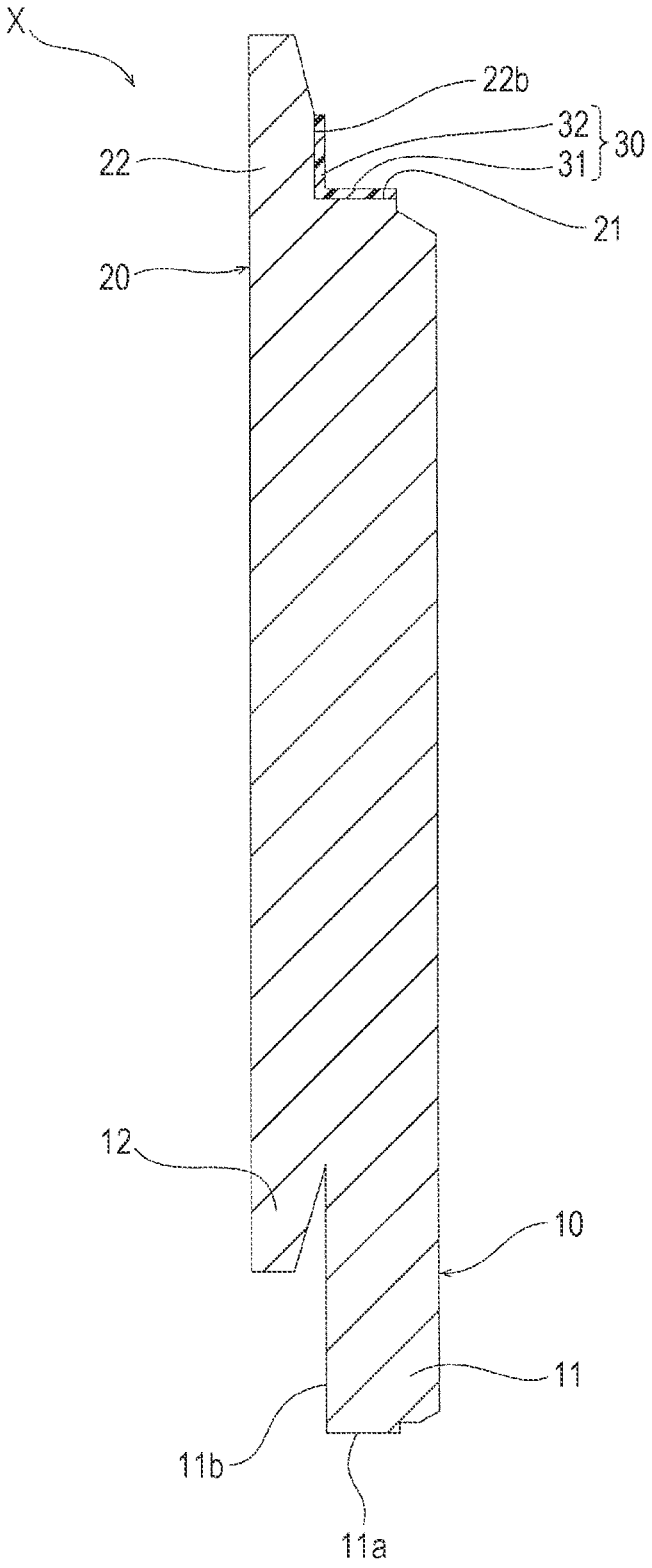
FIG. 6 illustrates one modification of the wall material illustrated in FIG. 1.

Alternatively, instead of the above-described configuration in which the resin film 30 is formed in both the first region and the second region, a configuration in which, as illustrated in FIG. 6, the resin film 30 is formed in the second region (the region stretching on the end surface 21 and on the extension surface 22*b* at the rear-side joint portion 20) and is not formed in the first region may be employed. In the wall material X illustrated in FIG. 6, specifically, the first resin film 31 is formed on the end surface 21 and is not formed on the end surface 11*a*, and the second resin film 32 is formed on the extension surface 22*b* and is not formed on the extension surface 11*b*. In this case, the thickness of the resin film 30 on the second region is, for example, 50 to 400 mm.

According to also a modification illustrated in FIG. 5 and FIG. 6, the resin film 30 can be appropriately interposed, in a state in which two sheets of the wall materials X are spliced together in the first direction D1 by being mutually aligned via the surface-side joint portion 10 and the rear-side joint portion 20 thereof, between the surface-side joint portion 10 and the rear-side joint portion 20.

Figure 7:
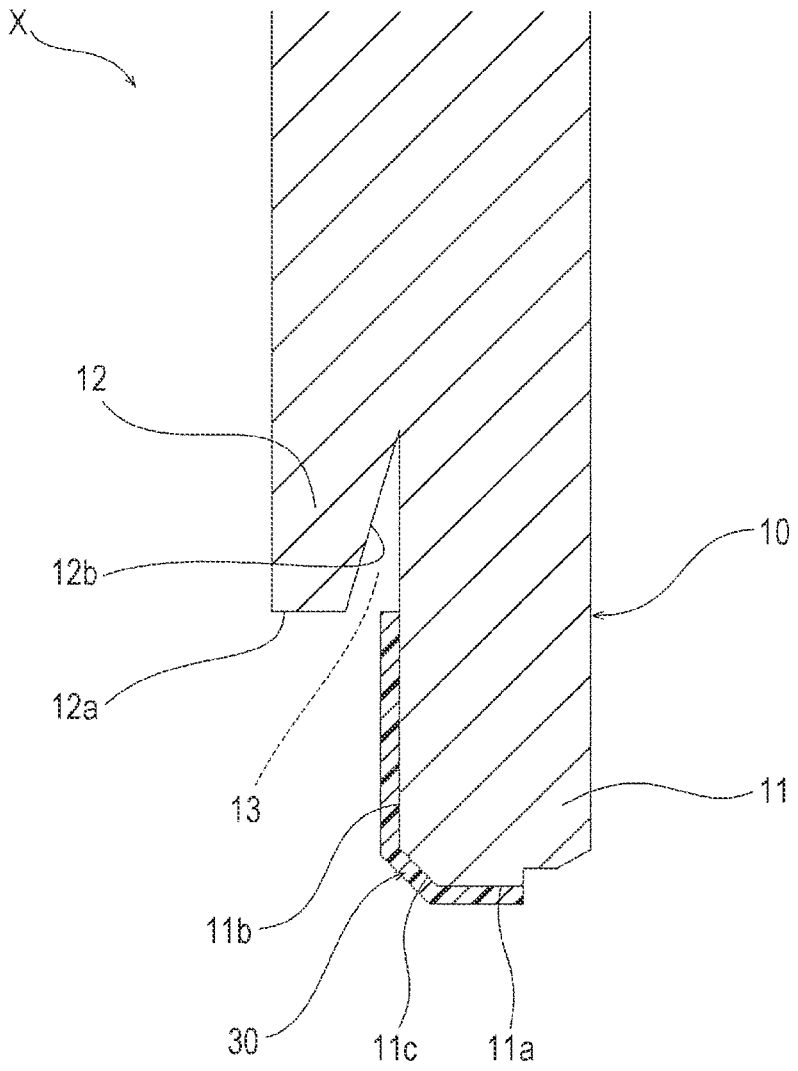
FIG. 7 illustrates one modification of the wall material illustrated in FIG. 1.

In the above-described wall material X, the surface-side extension portion 11 of the surface-side joint portion 10 may have, for example, a chamfered-shape portion 11*c*, such as that illustrated in FIG. 7, between the end surface 11*a* and the extension surface 11*b*. The chamfered-shape portion 11*c* may be, for example, an inclined flat surface inclined with respect to the end surface 11*a* and the extension surface 11*b*, may be a curved surface bulging outward between the end surface 11*a* and the extension surface 11*b*, and may be formed by a plurality of flat surfaces that are continuous by sequentially changing the inclination direction thereof between the end surface 11*a* and the extension surface 11*b*. FIG. 7 exemplarily illustrates a case in which the chamfered-shape portion 11*c* is the aforementioned inclined flat surface. The configuration in which the surface-side extension portion 11 has the chamfered-shape portion 11*c* is suitable for forming the resin film 30 that is continuous with a sufficient thickness on a thermoplastic-resin-film formation planned region in the surface-side joint portion 10.

The above-described resin film 30 at the wall material X may have a multilayer structure that includes a first layer on the resin-film formation planned region, and a second layer on the first layer (the resin-film formation planned region in the surface-side joint portion 10 is the aforementioned first region, and the resin-film formation planned region in the rear-side joint portion 20 is the aforementioned second region). In this case, preferably, the first layer includes air bubbles, and the second layer includes no air bubbles, or bubbles in the inside of the second layer are less than the bubbles in the inside of the first layer.

Such a resin film 30 is suitable for forming the first layer by applying and drying a relatively low-viscosity resin composition and then forming, on the first layer, the second layer by applying and drying a relatively high-viscosity resin composition. Applying and drying a relatively low-viscosity resin composition cause the composition to easily penetrate partially into a wall-material surface, thus cause air bubbles to easily enter the composition due to a fine irregular shape of the wall-material surface, but easily form the first layer exerting favorable adhesion with respect to the wall-material surface. Applying and drying a relatively high-viscosity resin composition on such a first layer easily form the second layer exerting favorable adhesion with respect to the first layer while preventing or suppressing mixing of air bubbles into the composition. The resin film tends to have higher water resistance as the amount of air bubbles mixed in the resin film is smaller. Therefore, the configuration in which the resin film 30 has the multilayer structure is suitable for forming the resin film 30 excellent in water resistance in a predetermined region with excellent adhesion.

Preferably, the first layer and the second layer described above contain the same resin as a main agent. Such a configuration is suitable for obtaining high adhesion between the first layer and the second layer.

In one preferred form, the first layer and the second layer described above are each a thermosetting resin coating. The thermosetting resin coating is excellent in water resistance and weather resistance and has excellent adhesion with respect to a wall material. Thus, the configuration in which the resin film has the multilayer structure with the thermosetting resin coating is suitable for forming a resin film excellent in weather resistance, in addition to water resistance, with excellent adhesion.

In one preferred form, the above-described first layer is a thermoplastic resin coating, and the second layer is a thermoplastic resin sheet. Such a configuration can be achieved by, for example, forming the first layer that is the thermoplastic resin coating through application and drying of a thermoplastic resin composition, and then forming, on the first layer, the second layer with the thermoplastic resin sheet. Applying and drying the thermoplastic resin composition cause the composition to easily penetrate partially into a wall-material surface, and thus easily form the first layer exerting favorable adhesion with respect to the wall-material surface. Applying and drying a relatively low-viscosity resin composition cause the composition to easily penetrate partially into a wall-material surface, thus easily cause air bubbles to enter the composition due to a fine irregular shape of the wall-material surface, but easily form the first layer exerting favorable adhesion with respect to the wall-material surface, which is preferable. Bonding the thermoplastic resin sheet to such a first layer easily form the second layer exerting favorable adhesion with respect to the first layer. The thermoplastic resin sheet is easily manufactured with high-precision in terms of the thickness dimension thereof and easily prepared as a sheet formed to have a uniform thickness. Accordingly, the aforementioned configuration is suitable for forming a resin film excellent in water resistance and adhesion with precision in thickness.

The wall material X may further have a caulking portion. Specifically, the wall material X may have a caulking portion that is positioned on at least one of the second resin film 32 on the extension surface 11*b* of the surface-side joint portion 10 and the second resin film 32 on the extension surface 22*b* of the rear-side joint portion 20.

The caulking portion is provided at the extension surface 11*b* or the extension surface 22*b* to extend in the extension direction (the second direction described above) of the extension surface. The caulking portion has, for example, a semicircular sectional shape. The caulking portion is a press-deformable resin element. Examples of the material of the caulking portion include, for example, a styrene-based block copolymer resin and an olefin-based resin. Examples of the styrene-based block copolymer resin include, for example, a styrene-butylene-ethylene-styrene copolymer resin, a styrene-isobutylene-styrene copolymer resin, and a styrene-butadiene-styrene copolymer resin. An example of the olefin-based resin is, for example, an olefin-based resin that contains a polypropylene resin as a matrix resin, and an ethylene-propylene rubber resin finely dispersed in the matrix resin.

Figure 8:
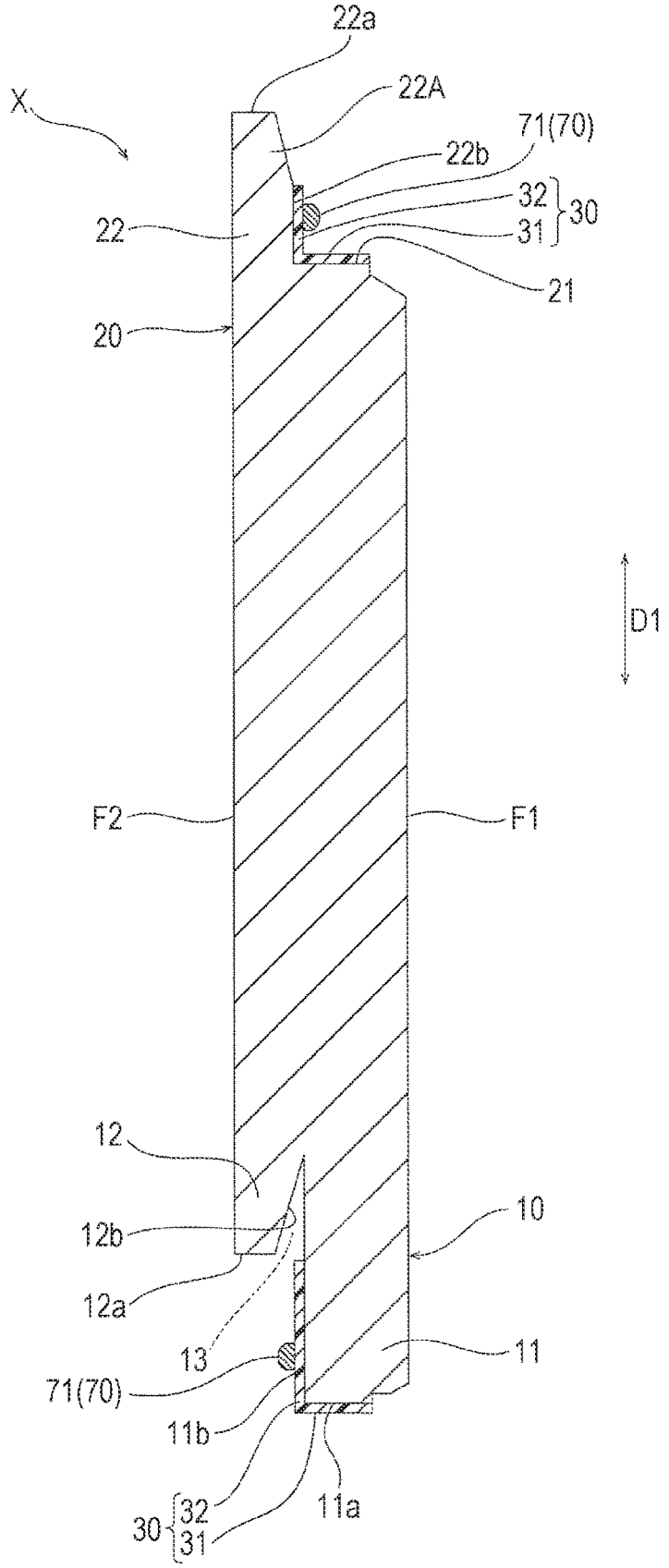
FIG. 8 illustrates one modification of the wall material illustrated in FIG. 1.
Figure 9:
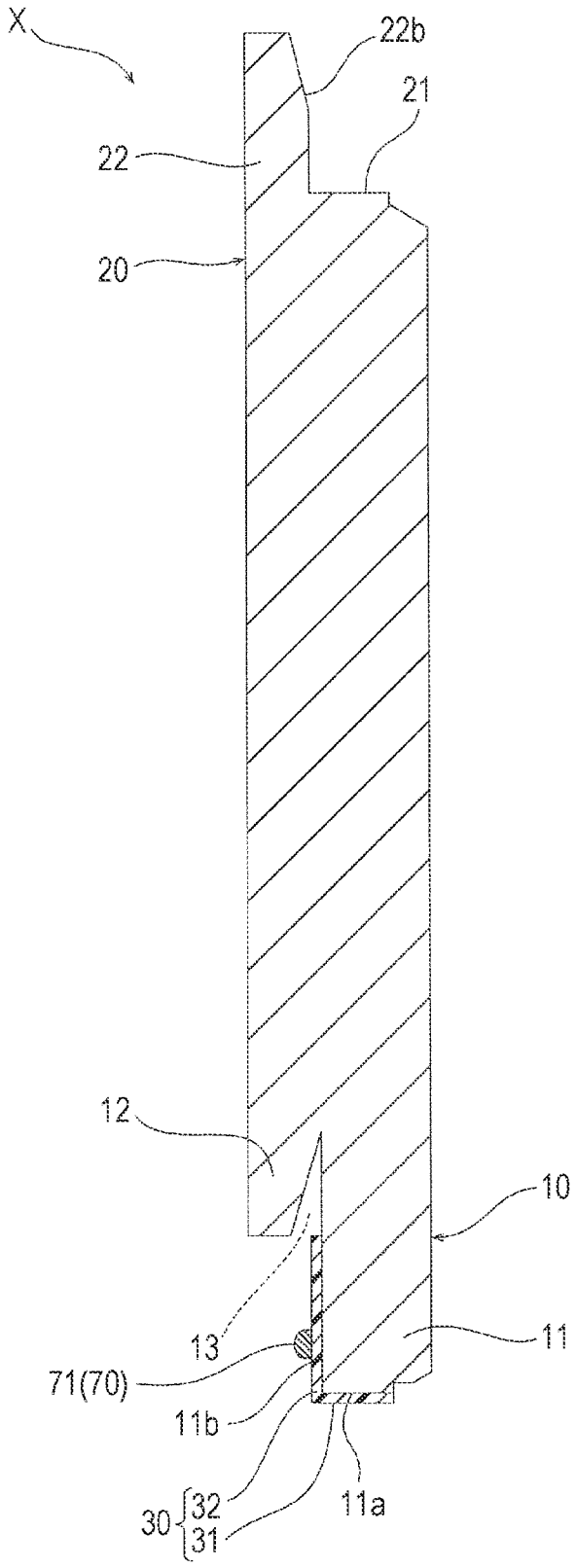
FIG. 9 illustrates one modification of the wall material illustrated in FIG. 1.
Figure 10:
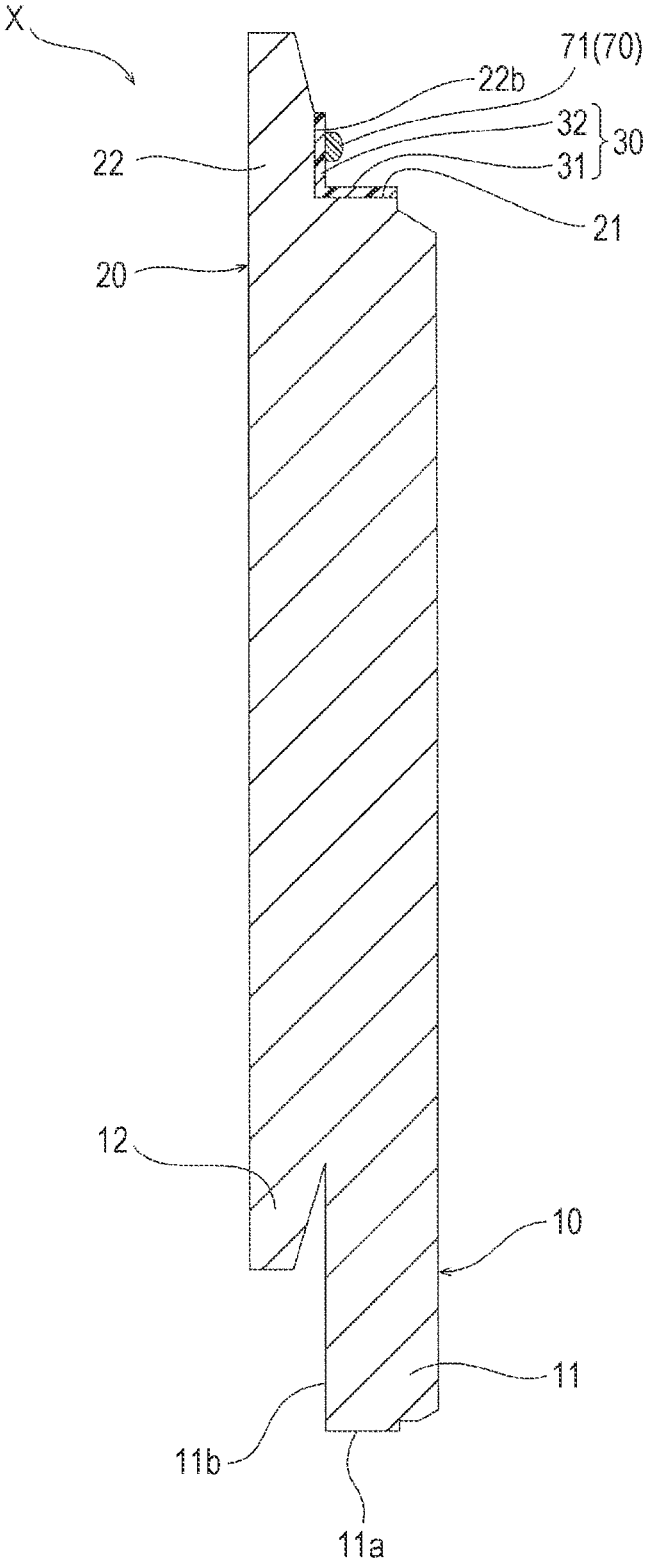
FIG. 10 illustrates one modification of the wall material illustrated in FIG. 1.

FIG. 8 illustrates a case in which the wall material X illustrated in FIG. 1 has a caulking portion 70 (first caulking portion 71) on both the second resin film 32 on the extension surface 11*b* and the second resin film 32 on the extension surface 22*b*. FIG. 9 illustrates a case in which the wall material X illustrated in FIG. 5 has the caulking portion 70 (first caulking portion 71) on the second resin film 32 on the extension surface 11*b*. FIG. 10 illustrates a case in which the wall material X illustrated in FIG. 6 has the caulking portion 70 (first caulking portion 71) on the second resin film 32 on the extension surface 22*b*.

Figure 11:
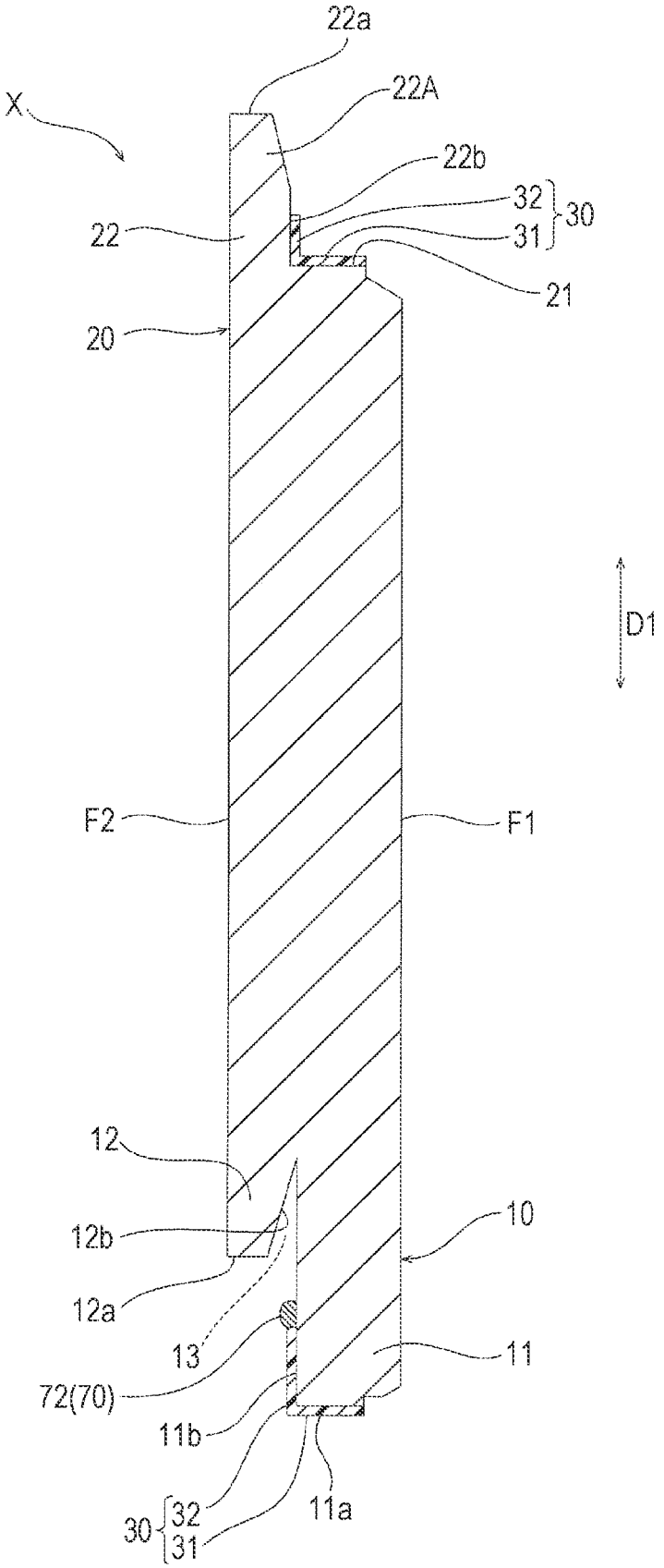
FIG. 11 illustrates one modification of the wall material illustrated in FIG. 1.

As illustrated in FIG. 11, the wall material X may have the resin film 30 (the first resin film 31 and the second resin film 32) stretching over the end surface 11*a* and the extension surface 11*b* at the surface-side joint portion 10, have the resin film 30 (the first resin film 31 and the second resin film 32) stretching over the end surface 21 and the extension surface 22*b* at the rear-side joint portion 20, and have the caulking portion 70 (second caulking portion 72) on the extension surface 11*b*. The second caulking portion 72 is positioned, on the extension surface 11*b*, on the other side in the first direction D1 from the second resin film 32 on the extension surface 11*b*. The second caulking portion 72 is thicker than the second resin film 32.

The second resin film 32 on the extension surface 22*b* at the wall material X illustrated in FIG. 11 has a shorter dimension in the first direction D1 than the second resin film 32 on the extension surface 22*b* at the wall material X illustrated in FIG. 1 (the position of the edge end on the other side is closer to the one side in the first direction D1). Such a configuration is employed so that, when wall materials X are spliced together by being mutually aligned in the first direction D1, the caulking portion 72 on the extension surface 11*b* at one wall material X can be in contact with the surface of the extension surface 22*b* at the other wall material X.

Figure 12:
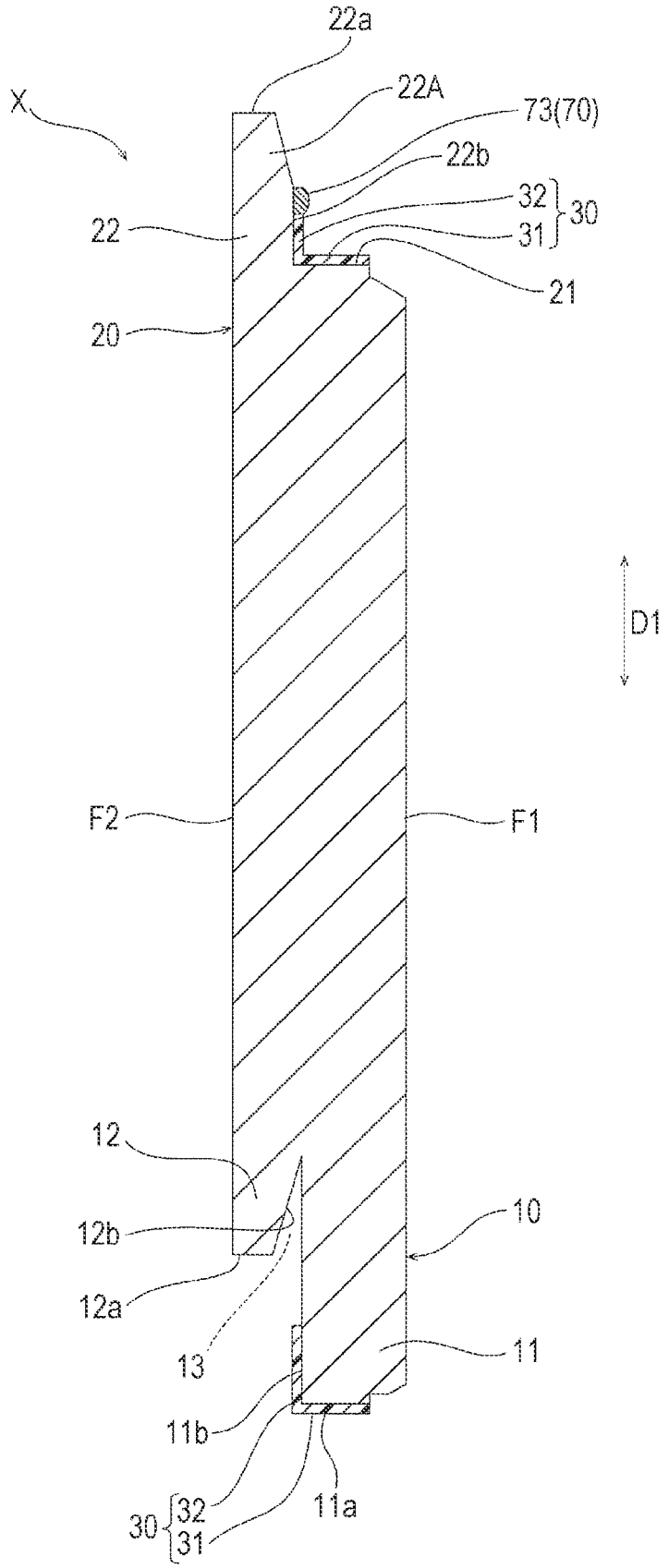
FIG. 12 illustrates one modification of the wall material illustrated in FIG. 1.

As illustrated in FIG. 12, the wall material X may have the resin film 30 (the first resin film 31 and the second resin film 32) stretching over the end surface 11*a* and the extension surface 11*b* at the surface-side joint portion 10, have the resin film 30 (the first resin film 31 and the second resin film 32) stretching over the end surface 21 and the extension surface 22*b* at the rear-side joint portion 20, and have the caulking portion 70 (third caulking portion 73) on the extension surface 11*b*. The third caulking portion 73 is positioned, on the extension surface 22*b*, on the other side in the first direction D1 from the second resin film 32 on the extension surface 22*b*. The third caulking portion 73 is thicker than the second resin film 32.

The second resin film 32 on the extension surface 11*b* at the wall material X illustrated in FIG. 12 has a shorter dimension in the first direction D1 than the second resin film 32 on the extension surface 11*b* at the wall material X illustrated in FIG. 1 (the position of the edge end on the other side is closer to the one side in the first direction D1). Such a configuration is employed so that, when wall materials X are spliced together by being mutually aligned in the first direction D1, the caulking portion 73 on the extension surface 22*b* at one wall material X can be in contact with the surface of the extension surface 11*b* at the other wall material X.

The aforementioned configurations in each of which the caulking portion 70 is utilized are suitable, when two sheets of the wall materials X2 are spliced together by being mutually aligned in the first direction D1 via the surface-side joint portion 10 and the rear-side joint portion 20 thereof, for causing the caulking portion 70 to be press-deformed between the extension surface 11*b* and the extension surface 22*b* and filling a gap between the extension surface 11*b* and the extension surface 22*b* with the second resin film 32 and the caulking portion 70 (that is, suitable for obtaining a water stopping function by cooperation of the second resin film 32 and the caulking portion 70). Therefore, the aforementioned configurations that each utilize the caulking portion 70 are useful for achieving high water resistance in the wall-material building structure Y.

REFERENCE SIGNS LIST

X wall material
F1 front surface
F2 rear surface
D1 first direction
D2 second direction
10 surface-side joint portion
11 surface-side extension portion
11*a* end surface (first end surface)
11*b* extension surface (first extension surface)
11*c* chamfered-shape portion
12 secured portion (first secured portion)
12*a* end surface
12*b* inclined surface
13 groove portion
20 rear-side joint portion
21 end surface (second end surface)
22 rear-side extension portion
22A secured portion (second secured portion)
22*a* end surface
22*b* extension surface (second extension surface)
31 resin film (first resin film)
32 resin film (second resin film)
Y wall-material building structure
40 support material
50 fastener
51 fixing portion
52 securing structure portion

The invention claimed is:

1. A wall material that has a front surface and a rear surface opposite to the front surface, the wall material comprising:

a surface-side joint portion positioned in one side in a first direction of the wall material, and a rear-side joint portion positioned in an other side in the first direction, wherein the surface-side joint portion has:

a surface-side extension portion positioned in the front surface side of the wall material, a first end surface formed in an end portion of the surface-side extension portion in the one side in the first direction, extended in the direction from the front surface toward the rear surface, a first extension surface formed in the surface-side extension portion to face the rear surface, extended in the other side in the first direction, and a first secured portion formed in the rear surface side of the wall material, positioned in a portion displaced from the first end surface in the other side in the first direction, wherein the rear-side joint portion has:

a second end surface formed in an end portion of the wall material in the other side in the first direction, extended in the direction from the front surface toward the rear surface, a rear-side extension portion positioned in the rear surface side of the wall material extended from the second end surface in the other side in the first direction, a second extension surface formed in the rear-side extension portion to face the front surface, extended in the other side in the first direction, and a second secured portion formed in an end side portion of the rear-side extension portion in the other side in the first direction, wherein the wall material further comprises:

at least one first resin film positioned on at least one of the first end surface and the second end surface, and at least one second resin film positioned on at least one of the first extension surface and the second extension surface, wherein no resin film is positioned in the first secured portion and the second secured portion.

2. The wall material according to claim 1, wherein at least one of the first resin film and the second resin film contains at least one resin selected from a group consisting of a thermoplastic resin, a thermosetting resin, and an ultraviolet-curable resin.

3. The wall material according to claim 1, wherein at least one of the first resin film and the second resin film is a resin sheet.

4. The wall material according to claim 1, wherein the surface-side joint portion has a chamfered-shape portion between the first end surface and the first extension surface, and the resin film at the surface-side joint portion is formed in a region stretching on the first end surface, on the chamfered-shape portion, and on the first extension surface.

5. The wall material according to claim 1, wherein the resin film includes a first layer as an underlayer, and a second layer on the first layer.

6. The wall material according to claim 5, wherein the first layer includes air bubbles, and wherein the second layer includes no air bubbles, or air bubbles in an inside of the second layer are less than the air bubbles in an inside of the first layer.

7. The wall material according to claim 5, wherein the first layer and the second layer are each a thermosetting resin coating.

8. The wall material according to claim 5, wherein the first layer is a thermoplastic resin coating, and the second layer is a thermoplastic resin sheet.

9. The wall material according to claim 1, further comprising a first caulking portion on at least one of the second resin film on the first extension surface, and the second resin film on the second extension surface.

10. The wall material according to claim 1, further comprising a second caulking portion that is positioned, on the first extension surface, on the other side in the first direction from the second resin film on the first extension surface, and that is thicker than the second resin film.

11. The wall material according to claim 1, further comprising a third caulking portion that is positioned, on the second extension surface, on the other side in the first direction from the second resin film on the second extension surface, and that is thicker than the second resin film.

12. The wall material according to claim 1, wherein the surface-side joint portion has a groove portion that is positioned on the other side from the first extension surface in the first direction, and the first secured portion that is positioned closer than the groove portion to the rear surface and that is adjacent to the first extension surface via the groove portion, wherein the rear-side joint portion has the second secured portion that is positioned closer than the second end surface to the rear surface and that extends further toward the other side in the first direction than the second end surface, and wherein, at a splice part where the surface-side joint portion of the one wall material and the rear-side joint portion of the wall material that differs from the one wall material are spliced together in the first direction, the first secured portion and the second secured portion are separated from and face each other in the first direction.

13. A wall-material building structure comprising: a support material; a first wall material and a second wall material that are fastened to the support material to be adjacent to each other in a first direction; and a fastener for fastening the first wall material and the second wall material to the support material, wherein each of the first wall material and the second wall material is the wall material according to wherein each of the first wall material and the second wall material is the wall material according to wherein the surface-side joint portion of the first wall material and the rear-side joint portion of the second wall material are spliced together in the first direction, and, at a splice part, in a state in which a gap between the first end surface of the surface-side joint portion and the second end surface of the rear-side joint portion is filled with at least the first resin film, the first end surface and the second end surface face each other while, in a state in which the gap between the first extension surface of the surface-side joint portion and the second extension surface of the rear-side joint portion is filled with at least the second resin film, the first extension surface and the second extension surface face each other, and wherein the fastener has a fixing portion that is fixed to the support material, and a securing structure portion that secures the first wall material and the second wall material.

* * * * *